US005791392A

United States Patent [19]

Fernandez Lopez

[11] Patent Number: 5,791,392

[45] Date of Patent: Aug. 11, 1998

[54] WOVEN FABRIC FOR USE AS A SHADE IN A ROLLER BLIND

[75] Inventor: Raimond Fernandez Lopez, Sabadell, Spain

[73] Assignee: L'Estor, S.L., Sabadell, Spain

[21] Appl. No.: 808,232

[22] Filed: Feb. 28, 1997

[51] Int. Cl.[6] ..... A47G 5/02

[52] U.S. Cl. ..... 160/238; 160/264; 160/DIG. 7

[58] Field of Search ..... 160/238, 264, 160/330, 348, 84.01, DIG. 7, 243, 370.22, 237; 139/383 R, 384 R, 385

[56] References Cited

U.S. PATENT DOCUMENTS

| | | | |
|---|---|---|---|
| 2,119,583 | 6/1938 | Kingsbury | 160/238 |
| 3,999,590 | 12/1976 | Koch | 160/84.01 |
| 4,765,388 | 8/1988 | Dohlemann | 160/84.01 |
| 4,934,435 | 6/1990 | Regev | 160/264 X |
| 5,099,905 | 3/1992 | Rigter | 160/264 X |
| 5,353,858 | 10/1994 | Hartmann | 160/264 X |
| 5,443,563 | 8/1995 | Hindel et al. | 160/264 X |
| 5,662,147 | 9/1997 | Haiber | 160/84.01 X |

FOREIGN PATENT DOCUMENTS

| | | |
|---|---|---|
| 106771 | 4/1984 | European Pat. Off. . |
| 517702 | 5/1921 | France . |
| 4320007 | 3/1994 | Germany . |
| 4419410 | 12/1995 | Germany . |
| 2237062 | 4/1991 | United Kingdom . |

*Primary Examiner*—David M. Purol
*Attorney, Agent, or Firm*—Klauber & Jackson

[57] ABSTRACT

A woven fabric for use as a shade in a roller blind which is rolled and unrolled, the woven fabric including a continuous flexible woven sheet. The sheet includes a plurality of bands extending across the sheet in a transverse direction and integrally woven therewith. Each band includes a front ply having an inner surface and an outer surface which forms part of the front surface of the sheet, and a rear ply having an inner surface and an outer surface which forms part of the rear surface of the sheet, the outer surface of the rear ply being provided with at least one opening disposed proximate at least one of the side edges and adapted to allow the insertion of a rod therethrough. The front and rear plies are spaced apart from each other to form a pocket between their respective inner surfaces, the pocket being adapted to accommodate the rod. A pair of transverse cords, integrally woven with the rear ply, are disposed in the center of the outer surface of the rear ply. The pair of cords are spaced apart from the rear ply at at least one location to form at least one eyelet having an opening adapted to allow the passage of a thread therethrough. The fabric may also include a wide lower band for holding a weight. An upper portion of the sheet may have a hook and/or loop member which is integrally woven in the sheet.

6 Claims, 5 Drawing Sheets

A-B

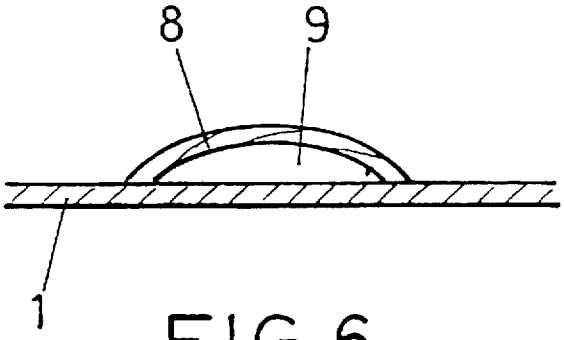
FIG. 6
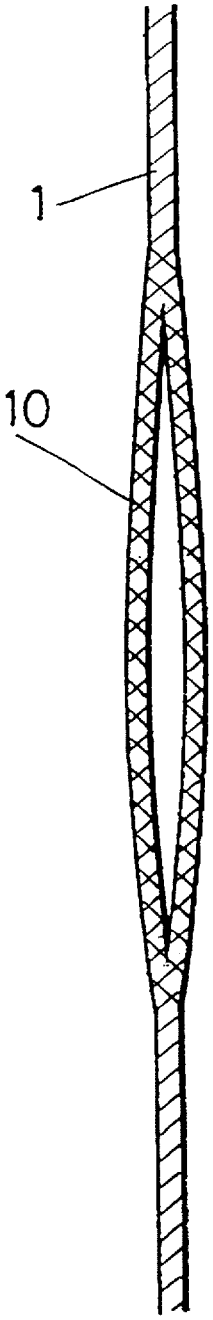
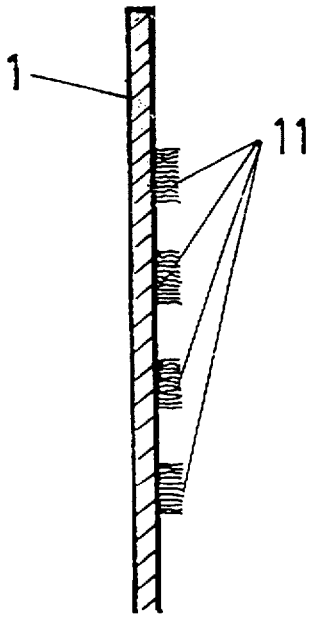
FIG. 8
E-F
FIG. 7
C-D

WOVEN FABRIC FOR USE AS A SHADE IN A ROLLER BLIND

OBJECT OF THE INVENTION

The present invention relates to an improved woven fabric for use in the production of roller blinds, which permit the manufacture of a roller blind in a rapid and simple manner, with the subsequent cost savings and with an improved finish and presentation as compared to known conventional roller blinds.

The object of the invention is to provide a fabric which incorporates transverse strips or bands which define pockets for the housing of rods associated with a roller blind, and which also incorporates a lower hem for a lower flat bar and an upper hooked and/or looped strip for the attachment of the roller blind on a tiedown support and carrier of the corresponding mechanisms of the roller blind. All of the elements i.e. the bands for the housing of the rods, the lower hem for the housing of the flat bar and the upper attachment strip of the roller blind, are integrally formed during a single weaving process of the fabric eyelets which accommodate the passage of the rolling/unrolling threads of the roller blind are also fabricated in the same weaving process, as well as the openings in the bands which allow the introduction of the rods.

BACKGROUND OF THE INVENTION

As is known, the manufacture of roller blinds is enormously complex and slow, additionally requiring specialized personnel. Moreover, it is difficult to achieve an acceptable finish on an unfolded surface on conventional roller blinds.

The complexity of the production of the known roller blind results from a sheet fabric on which a plurality of strips must be transversely, e.g. horizontally, attached, typically at regular intervals, and which must be sewn through their longitudinal edges to the fabric, such as on the rear face of the same, in order to define a receptacle for the transverse rods between the strip and the fabric on which it is sewn, which the roller blinds incorporate at generally regular intervals.

Likewise, during the manufacture of the roller blind, it is necessary to form a hem at the lower edge where a flat bar, which acts as a weight for the roller blind, shall be attached.

It is equally necessary to attach loops onto the strips for conventional roller blinds for the passage of the threads for rolling/unrolling the roller blind.

Another operation performed in the manufacture of the roller blind is the transversal attachment on the upper part of an adhesive strip, preferably VELCRO®, to attach the roller blind assembly to another complementary strip attached on the support which is attached to a wall or roof for the suspension of the roller blind, and the support of which incorporates the corresponding mechanisms to carry out the corresponding rolling/unrolling.

Additionally, it is necessary to form a hem along the sides to finish the manufacture of the roller blind. In the totality of the above operations, the time employed is great, wherein it is also necessary to suitably attach, correctly parallel, the strips for the passage of the rods as well as the formation of a parallel lower hem.

Finally, the resulting roller blinds are expensive, as a consequence of the cost involved in their construction. Furthermore, the end result of such construction is a finish which is never completely perfect, since the seams for the attachment of the strips and for the formation of the hem always cause small wrinkles, which are clearly seen when the roller blind is unrolled.

SUMMARY OF THE INVENTION

The manufacture of the roller blinds according to the improvements of the invention, permit the production of a roller blind in a simple and rapid manner, with an optimum finish, since both the housing strips for the rods and the lower hem for the flat bar and the upper attachment strip of the roller blind, and even the eyelets for the rolling/unrolling threads of the roller blind, are obtained during a single weaving of the fabric, i.e., they are integrally woven with the fabric itself, and do not constitute additional elements or items, as is found in known construction of roller blinds.

Housing strips for the rods, which are obtained during the actual weaving stage of the fabric, are determined by two plies, forming bands in continuity with the actual fabric, between which plies is defined a pocket for the rod, with the particularity that in proximity to the ends, one of said plies, specifically the one considered as rear, is provided with an opening through which the end of the rod may be introduced, transversely into the pocket between the two plies of the band or strip.

Moreover, during the weaving of said transversal bands, and indeed the fabric in general, two cords are woven on the rear ply but which, at regular intervals or at suitable distances, present small sections not woven with the ply, i.e. the cords are spaced apart from the rear ply to form eyelets for the passage of the threads for rolling/unrolling the roller blind.

Another novel characteristic presented by the fabric of the invention is a lower hem which is similarly obtained during the actual process of weaving of the fabric, since similarly to the bands or strips for housing the rods, said lower hem also forms a woven band, of greater width, to receive the corresponding flat bar used as weight in the roller blinds.

Another novel characteristic of the present invention is the existence of an upper part, instead of attaching a VELCRO® or hook and loop strip, as is traditionally done, rather the provision of small cords of hooked and/or looped thread in proximity and parallel to each other, which are perfectly attachable by adhesion to the traditional VELCRO® or hook and loop strip which is attached to the suspension support of the roller blind.

Of course the fabric of the present invention may be produced with an undefined length, in which an undefined number of sections exist with the previously indicated characteristics, so that each one of said sections shall constitute the portion from which the final roller blind is obtained, since the same includes all its components with the exception of the hems which shall generally be performed along the flanks or sides.

The fact that the manufacture of the roller blind is practically carried out during the actual weaving stage of the corresponding fabric, presents a series of advantages among which, including the following:

Since the bands or strips, hems and small cords of hook and/or loop threads are woven, no seams, roughness nor small bends exist which are normally caused by the seams of a conventional fabric, so that the roller blind, in its unrolling, remains perfectly smooth, and on which the bands or strips may be of the same color or of different color to the fabric, or may be a combination of colors, etc., though always forming a totally smooth surface without the least, minimum wrinkle, and, what is more important, with a perfect positioning of the bands or strips, with which the rods always remain parallel to each other as well as the lower flat bar, thus allowing the attainment of a roller blind having an improved finish.

Another advantage consists in the production time saving as compared to conventional roller blinds, since the fabric which forms the shade of the roller blind comes out practically from the loom, leaving only the introduction of the rods, and forming the hems of the sides.

BRIEF DESCRIPTION OF THE DRAWINGS

To complement the following description and in order to better understand of the characteristics of the invention, the present Specification is enclosed with a set of drawings, based on which, the innovations and advantages of the invention shall be more easily understood.

FIG. 5 shows a sectional detail corresponding to section A–B of FIG. 4, showing the pocket defined by the plies of the bands transversally woven in the fabric, as well as the eyelet which is disposed at regular intervals in the pair of cords woven on one of the plies of the band it forms a part of.

FIG. 6 shows a lateral detail of the eyelet which at regular intervals, is defined by the cords woven on the transversal band represented in FIG. 5.

FIG. 7 shows a sectional view corresponding to section C–D of FIG. 4, where the formation of the pocket corresponding to the lower band for housing the corresponding flat bar of the roller blind may be observed.

FIG. 8 shows a sectional detail corresponding to section E–F of FIG. 4, where the small cords of hook and/or loop thread, woven on the fabric for the attachment of the roller blind to be obtained on corresponding suspension support, is observed.

DESCRIPTION OF THE PREFERRED EMBODIMENT

Figure 1:
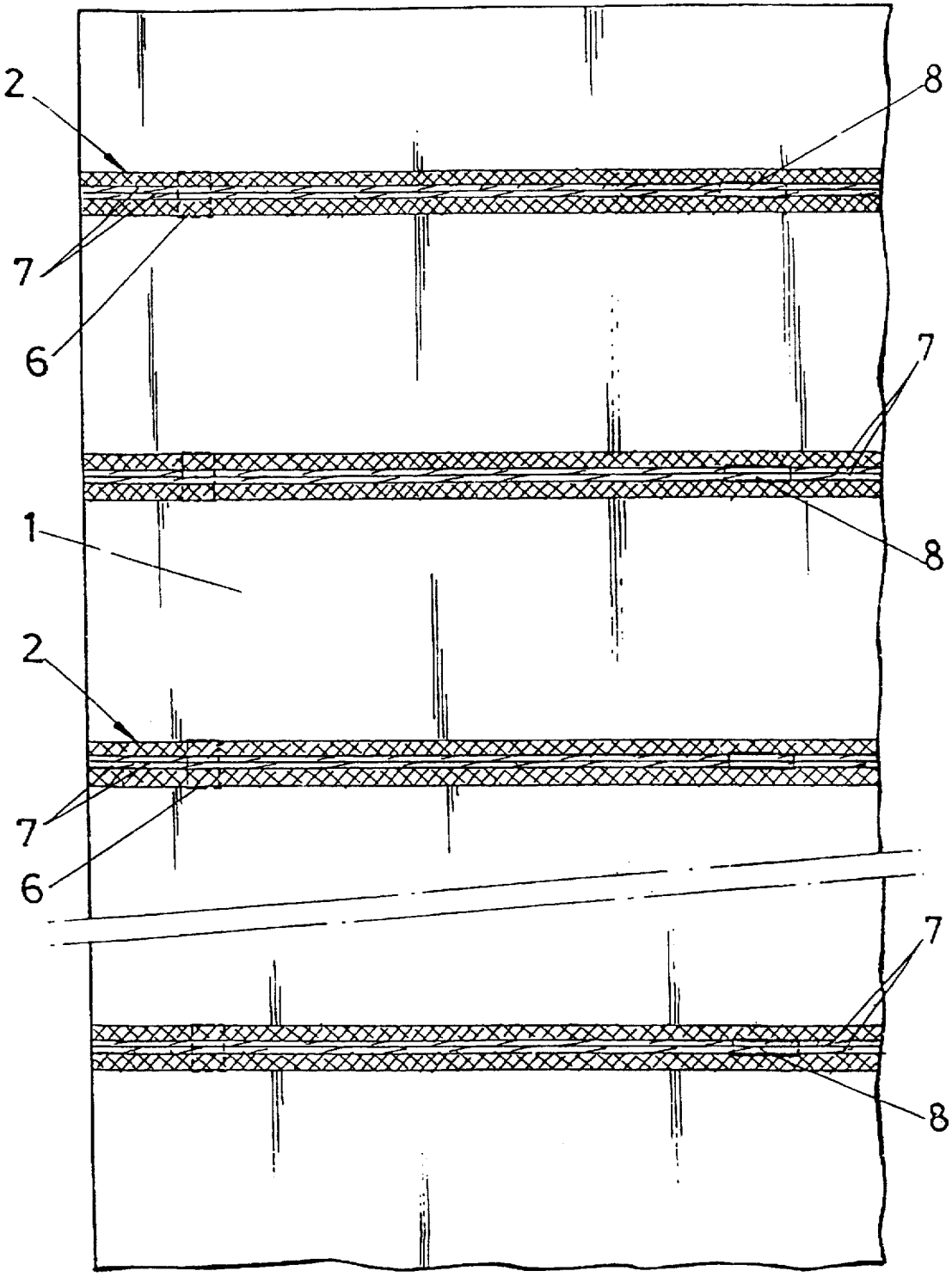
FIG. 1 shows a view of a face which may be considered as the rear face of a portion of the fabric equipped with transversal strips for housing the corresponding rods of a roller blind, as well as the cords on which the eyelets for the passage of the threads for rolling/unrolling the roller blind are determined, which are integrally woven with the fabric.
Figure 2:
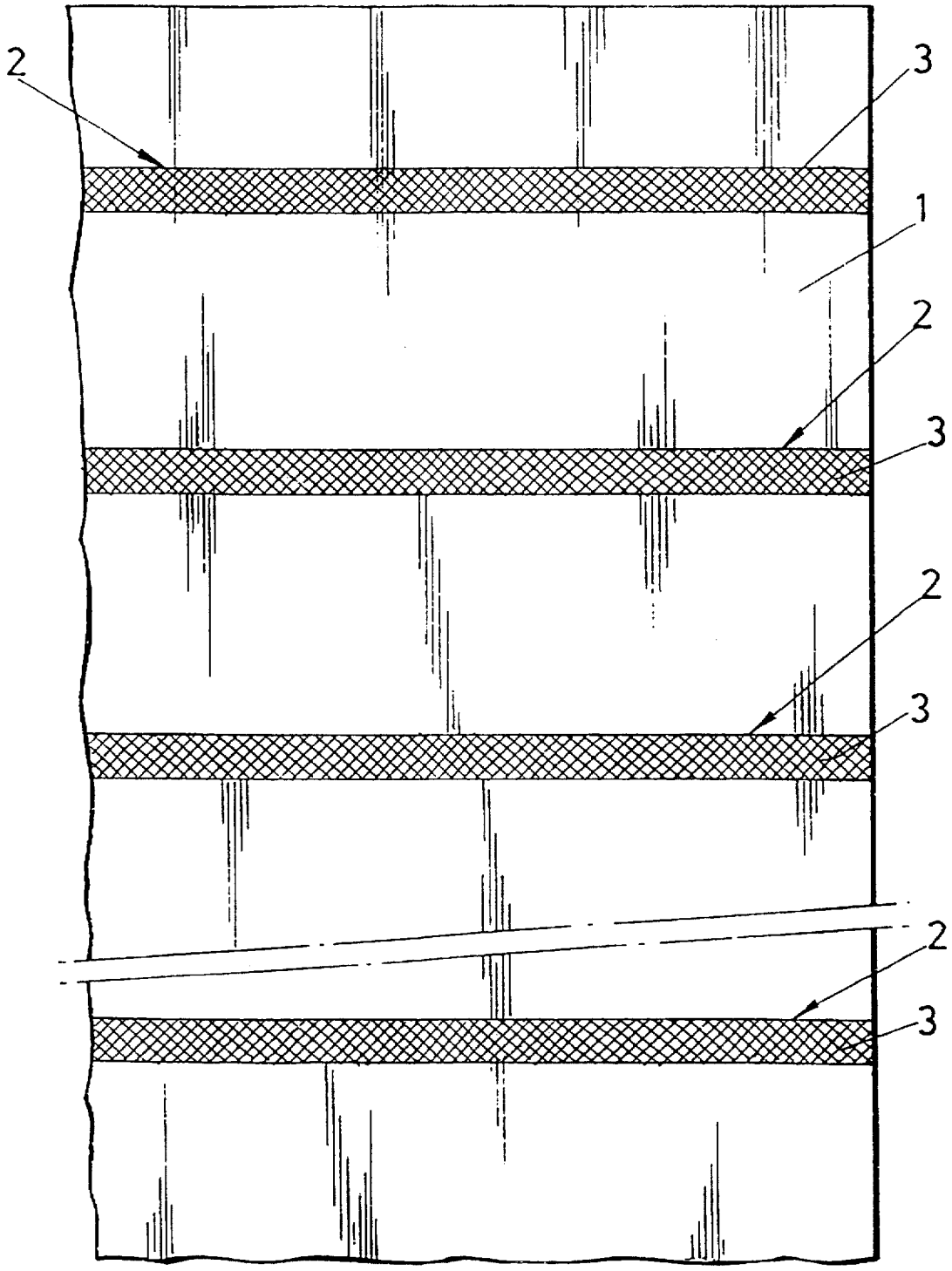
FIG. 2 shows the same portion of fabric of FIG. 1, viewed on the front face.

In view of the above described figures, the manufacture of a roller blind, in accordance with the present invention, can be assembled in manner similar to the conventional manner using an improved fabric 1, which is woven to integrally incorporate various components of the roller blind.

According to the invention, fabric 1, of undefined length, presents successively, and without sacrificing continuity, a sheet of a series of sections which can be used a shade in a roller blind.

Thus, each corresponding section or portion of fabric 1 includes at regular intervals, and in a cross-wise or transverse direction, a series of bands 2 obtained during the weaving of fabric 1. The bands 2 may be made of the same type of thread as for the remainder of the sheet of fabric 1 or may be of a different type, or even of the same or different color, or else formed by a combination of colors.

Each band 2 comprises two plies 3 and 4, defining between them, a pocket 5 for housing the corresponding rod which a roller blind typically carries at regular intervals and wherein each one of the pockets 5 is defined by different bands 2.

Ply 3 of band 2 is disposed on the face which may be considered as front face, and ply 4 of band 2 is disposed on the rear face.

Band 2, and specifically, the ply considered as rear ply 4, includes in proximity to its ends, an interruption or cut or opening 6 which forms a mouth for the introduction of the end of the respective rod and housing of the same in pocket 5 of the band 2.

Furthermore, during the weaving of band 2 and equally woven with ply 4 of the rear face, two cords 7 are woven, which, at regular intervals, considerably spaced from each other, presenting sections 8 so as not to be woven with rear ply 4, thereby defining eyelets 9 for the passage of threads for rolling/unrolling the roller blind.

Another novel characteristic presented by fabric 1 is a lower part of the portion or section which includes a band 10 of considerable width, said band being equally woven similarly to the narrower bands 2, to determine the pocket or housing for the corresponding flat bars which the roller blinds carry on their lower part.

On an upper zone of the portion of fabric 1, and similarly produced during the actual weaving process, narrow strips 11 of hooked and/or looped thread are formed, which function as an attachment means of the roller blind to a corresponding adhesive strip, VELCRO® or hook and loop type, provided on a corresponding suspension support for the roller blind, including the carrier of the mechanism for the activation of the rolling/unrolling of the actual roller blind.

Figure 3:
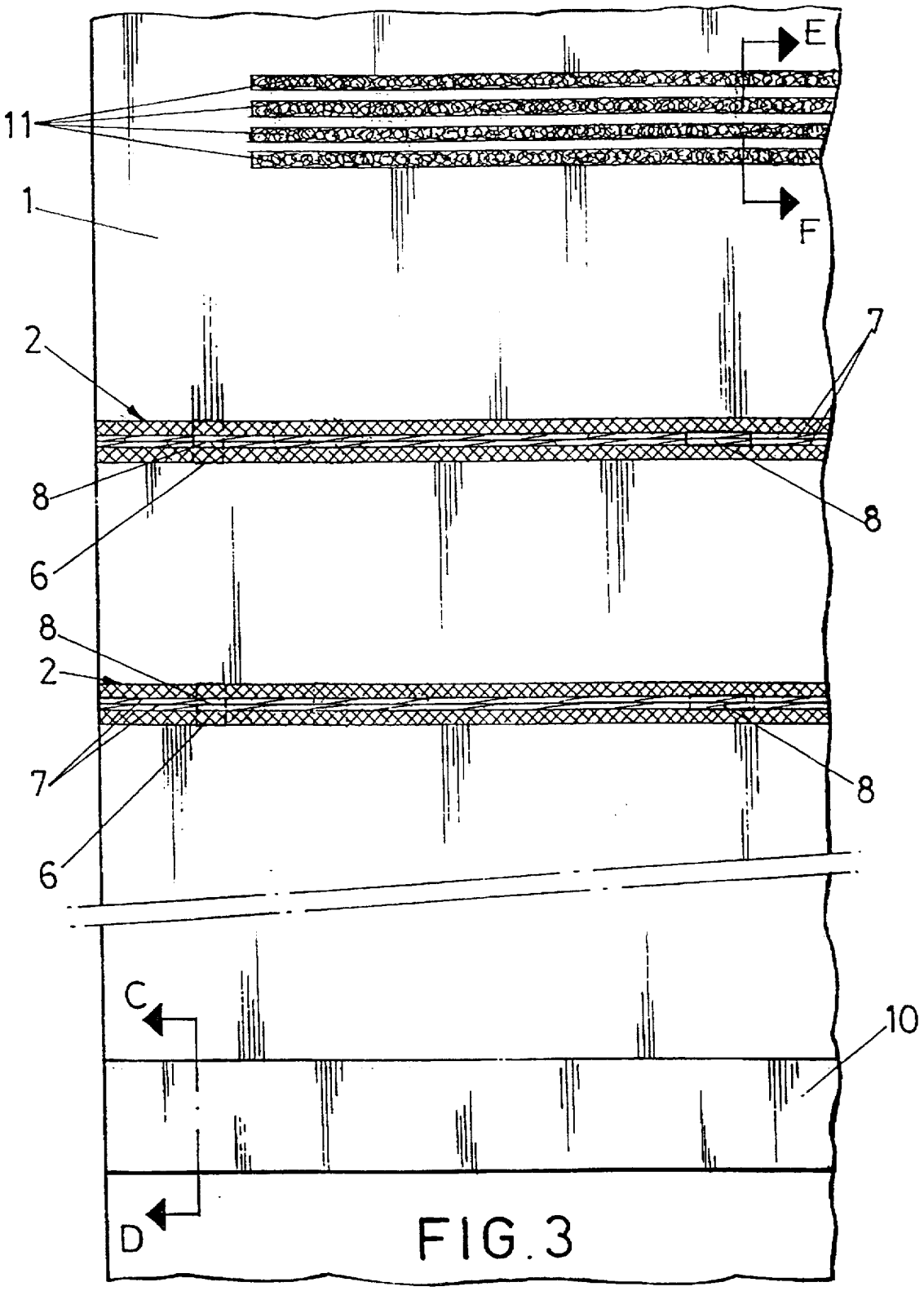
FIG. 3 shows another portion of the fabric of FIG. 1 on the rear face, which includes the transversal bands of FIG. 1, and additionally, a lower band of greater width which determines the hem for the flat bar of a roller blind, and the small cords of hooked and/or looped thread situated on the upper part for the attachment of the roller blind which shall be obtained from the portion of fabric represented in this figure.
Figure 4:
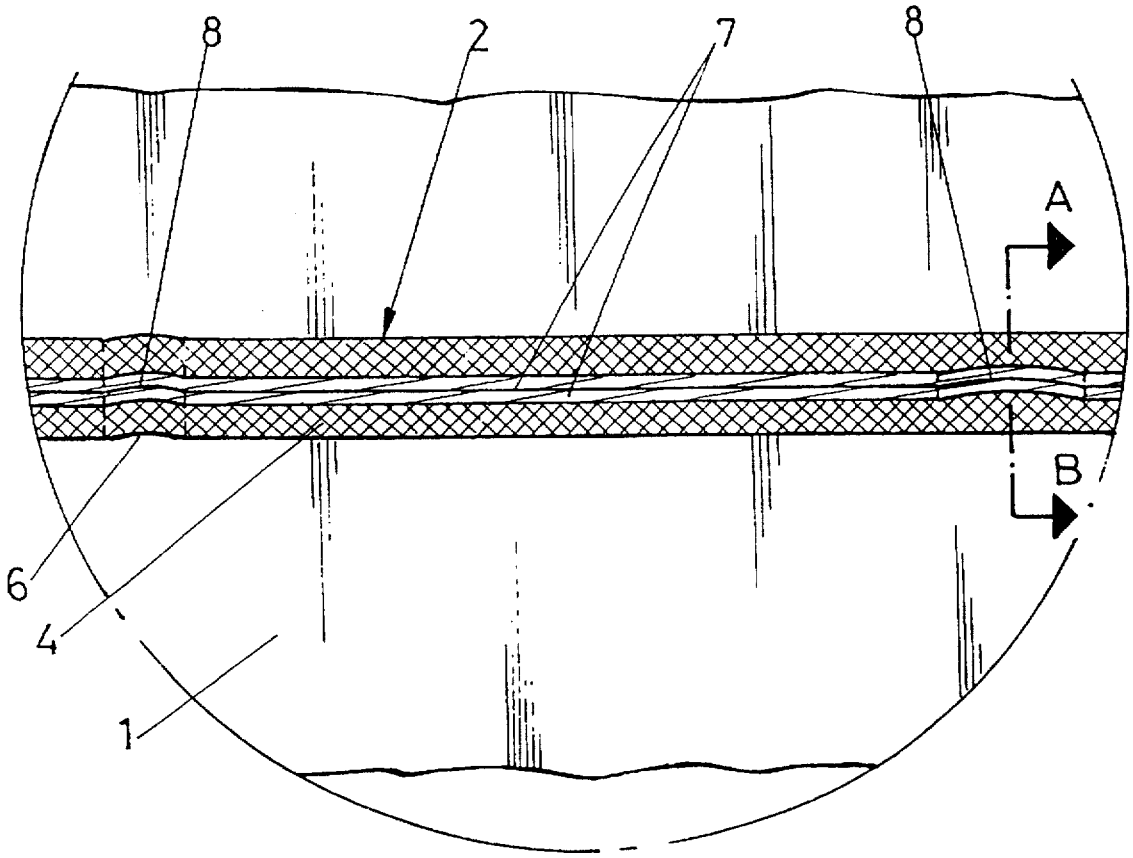
FIG. 4 shows an enlarged detail of a section of one of the transversal bands.
Figure 5:
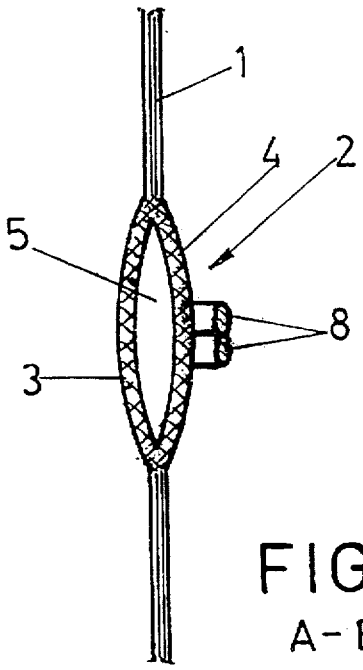

As may be observed in FIGS. 1 and 3, cuts or openings 6 of bands 2 for the introduction of the rods of the roller blind, as well as sections 8 which determine the eyelets for the passage of the rolling/unrolling threads, as well as the narrow strips 11 for the attachment of the roller blind, are provided on the face considered as rear face of fabric 1, while on the front face only the strips 2 are observed on the surface as a smooth continuous front, since all the above is woven with the actual fabric 1, forming an integral part of the same, with which the front surface of the roller blind does not contain any seams, roughness, or anomaly of any type, since the front surface shall be a totally flat surface on which bands 2 and even the lower band 10 may be of the same or of different material, of the same or different color, or may be a combination of colors, but always forming a surface without loss of continuity with the remaining surface of fabric 1.

I claim:

1. A woven fabric for use as a shade in a roller blind which is longitudinally rolled and unrolled, the roller blind including at least one longitudinally extending thread for controlling the rolling and unrolling of the shade, the shade being capable of accommodating at least one transverse rod, said woven fabric comprising a continuous flexible woven sheet having a front surface, a rear surface, and two side edges, said sheet including:

a plurality of bands extending across said sheet in a transverse direction and integrally woven therewith, wherein each said band comprises:

a front ply having an inner surface and an outer surface which forms part of the front surface of said sheet; and a rear ply having an inner surface and an outer surface which forms part of the rear surface of said sheet, the outer surface of said rear ply being provided with at least one opening disposed proximate at least one of said side edges and adapted to allow the insertion of the rod therethrough;

wherein said front and rear plies are spaced apart from each other to form a pocket between their respective inner surfaces, said pocket being adapted to accommodate said transverse rod; and a pair of cords disposed in the transverse direction in the center of the outer surface of said rear ply, said pair of cords being integrally woven with said rear ply;

wherein said pair of cords are spaced apart from said rear ply at at least one location to form at least one eyelet having a longitudinal opening adapted to allow the passage of the thread therethrough.

2. The woven fabric according to claim 1 wherein said sheet has a bottom edge, and wherein said plurality of bands further comprises a lower band disposed proximate the bottom edge, said lower band having a width substantially greater than at least one other of said bands, whereby the front and rear plies of said lower band form a pocket which accepts a flat bar.

3. The woven fabric according to claim 1 wherein said sheet has a top edge, said sheet further comprising an attachment portion proximate the top edge which includes at least one of a plurality of hook members and a plurality of loop members, said attachment portion being integrally woven with said sheet and disposed on the rear surface thereof.

4. The woven fabric according to claim 1 wherein said sheet further comprises a plurality of equal sections demarcated by a respective one of said bands, wherein the front surface of said sheet is essentially smooth when unrolled.

5. A woven fabric for use as a shade in a roller blind which is longitudinally rolled and unrolled, the roller blind including at least one longitudinally extending thread for controlling the rolling and unrolling of the shade, the shade being capable of accommodating at least one transverse rod, said woven fabric comprising a continuous flexible woven sheet having a front surface, a rear surface, a top edge, a bottom edge, and two side edges, said sheet including:

a plurality of bands extending across said sheet in a transverse direction and integrally woven therewith, wherein each said band comprises:

a front ply having an inner surface and an outer surface which forms part of the front surface of said sheet; and a rear ply having an inner surface and an outer surface which forms part of the rear surface of said sheet, the outer surface of said rear ply being provided with at least one opening disposed proximate at least one of said side edges and adapted to allow the insertion of the rod therethrough;

wherein said front and rear plies are spaced apart from each other to form a pocket between their respective inner surfaces, said pocket being adapted to accommodate said transverse rod; and a pair of cords disposed in the transverse direction in the center of the outer surface of said rear ply, said pair of cords being integrally woven with said rear ply;

wherein said pair of cords are spaced apart from said rear ply at at least one location to form at least one eyelet having a longitudinal opening adapted to allow the passage of the thread therethrough;

wherein said plurality of bands includes a lower band disposed proximate the bottom edge, said lower band having a width substantially greater than at least one other of said bands, whereby the front and rear plies of said lower band form a pocket which accepts a flat bar; and an attachment portion proximate the top edge which includes at least one of a plurality of hook members and a plurality of loop members, said attachment portion being integrally woven with said sheet and disposed on the rear surface thereof.

6. A woven fabric for use as a shade in a roller blind which is longitudinally rolled and unrolled, the roller blind including at least one longitudinally extending thread for controlling the rolling and unrolling of the shade, the shade being capable of accommodating at least one transverse rod, said woven fabric comprising a continuous flexible woven sheet having a front surface, a rear surface, a top edge, a bottom edge, and two side edges, said sheet including:

a plurality of bands extending across said sheet in a transverse direction and integrally woven therewith, wherein each said band comprises:

a front ply having an inner surface and an outer surface which forms part of the front surface of said sheet; and a rear ply having an inner surface and an outer surface which forms part of the rear surface of said sheet, the outer surface of said rear ply being provided with at least one opening disposed proximate at least one of said side edges and adapted to allow the insertion of the rod therethrough;

wherein said front and rear plies are spaced apart from each other to form a pocket between their respective inner surfaces, said pocket being adapted to accommodate said transverse rod; and a pair of cords disposed in the transverse direction in the center of the outer surface of said rear ply, said pair of cords being integrally woven with said rear ply;

wherein said pair of cords are spaced apart from said rear ply at at least one location to form at least one eyelet having a longitudinal opening adapted to allow the passage of the thread therethrough;

wherein said plurality of bands includes a lower band disposed proximate the bottom edge, said lower band having a width substantially greater than at least one other of said bands, whereby the front and rear plies of said lower band form a pocket which accepts a flat bar; and an attachment portion proximate the top edge which includes at least one of a plurality of hook members and a plurality of loop members, said attachment portion being integrally woven with said sheet and disposed on the rear surface thereof;

wherein said sheet is divided into a plurality of equal sections demarcated by a respective one of said bands, wherein the front surface of said sheet is essentially smooth when unrolled.

* * * * *

UNITED STATES PATENT AND TRADEMARK OFFICE

CERTIFICATE OF CORRECTION

PATENT NO. : 5,791,392

DATED : August 11, 1998

INVENTOR(S) : Raimond FERNANDEZ LOPEZ

It is certified that error appears in the above-indentified patent and that said Letters Patent is hereby corrected as shown below:

On the title page, item [30] Foreign Application Priority Data, add

--February 29, 1996 SPAIN 9600480--

Signed and Sealed this

Eighth Day of December, 1998

Bruce Lehman

*Attest:*

BRUCE LEHMAN

*Attesting Officer*

*Commissioner of Patents and Trademarks*